United States Patent [19]

Stafford

[11] 4,335,979

[45] Jun. 22, 1982

[54] OFFSHORE TOWER WITH BALL AND SOCKET JOINT HAVING FLUID FLOW PASSAGE

[75] Inventor: Donald C. Stafford, Hinsdale, Ill.

[73] Assignee: Chicago Bridge & Iron Company, Oak Brook, Ill.

[21] Appl. No.: 191,352

[22] Filed: Sep. 29, 1980

[51] Int. Cl.[3] ..... E02B 17/00

[52] U.S. Cl. ..... 405/202

[58] Field of Search ..... 405/195, 202, 169; 137/236.5; 166/350, 359; 9/8 P; 285/261, 272

[56] References Cited

U.S. PATENT DOCUMENTS

| | | | |
|---|---|---|---|
| 4,026,119 | 5/1977 | Dotti | 405/202 |
| 4,137,722 | 2/1979 | Mossiossian et al. | 405/202 |
| 4,155,670 | 5/1979 | Stafford | 405/202 |
| 4,254,521 | 3/1981 | Papmahl | 405/202 |

*Primary Examiner*—David H. Corbin

*Attorney, Agent, or Firm*—Merriam, Marshall & Bicknell

[57] ABSTRACT

An offshore tower having a buoyant column; a yoke at the lower end of the column; a socket joined to the end of the yoke; a base, adapted to be anchored to a sea floor, having a ball which fits in the socket for rotational joined movement relative to each other; a fluid delivery passageway, extending through the base and ball, communicating with a fluid swivel above the ball; and a fluid conduit having a flexible portion, extending outwardly from the fluid swivel and into engagement with the column.

5 Claims, 5 Drawing Figures

FIG. 1
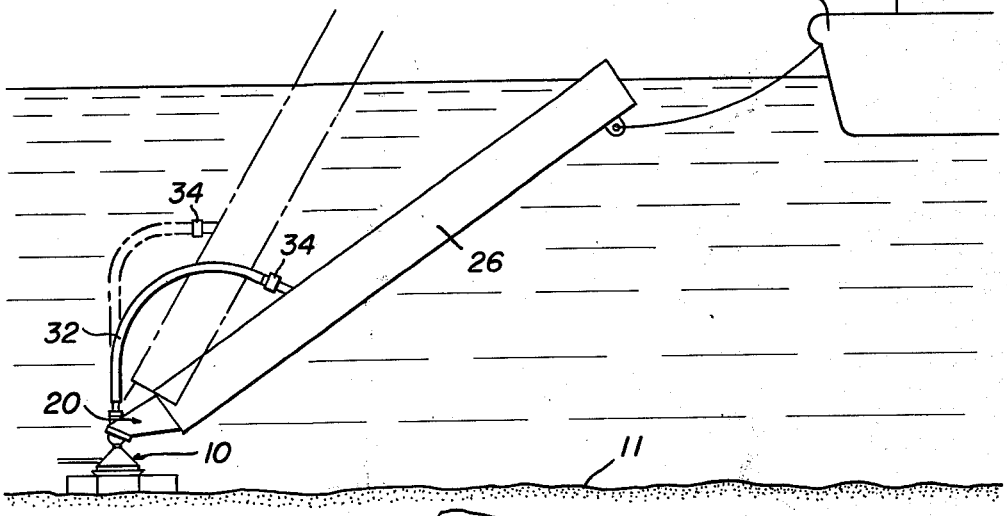
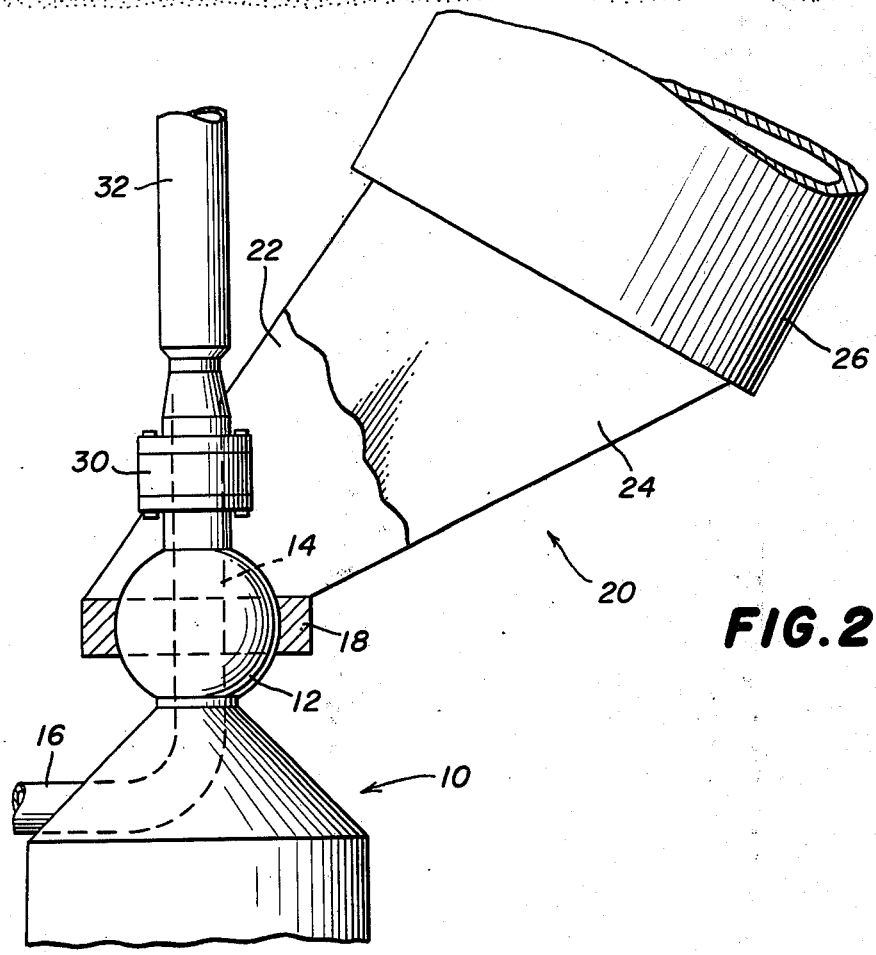
FIG. 2

FIG. 3
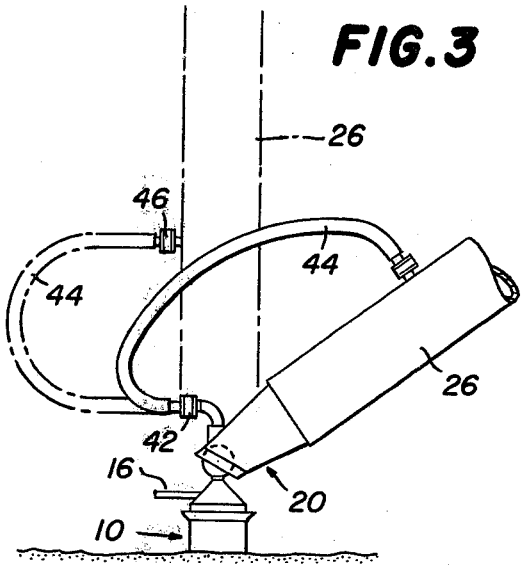
FIG. 4
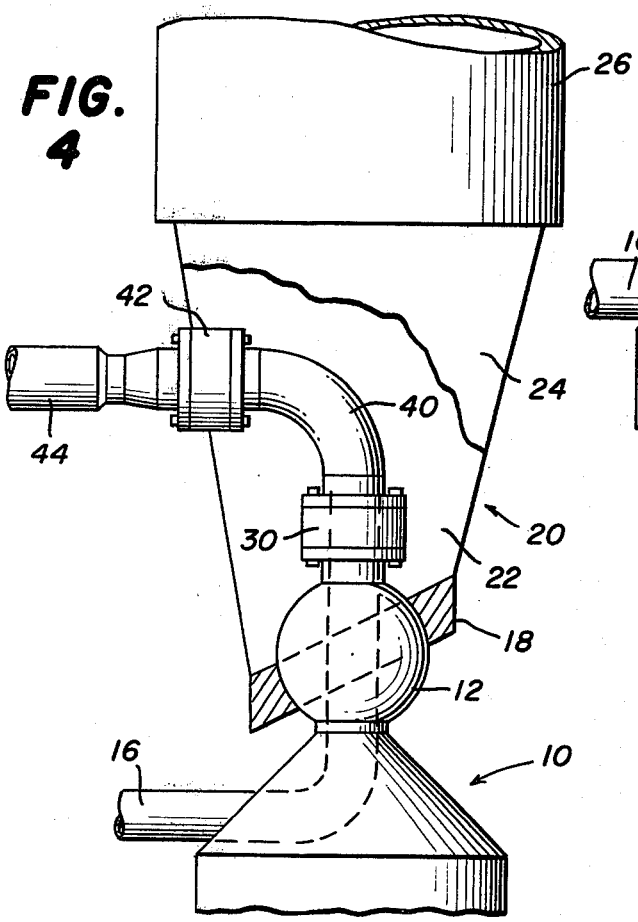
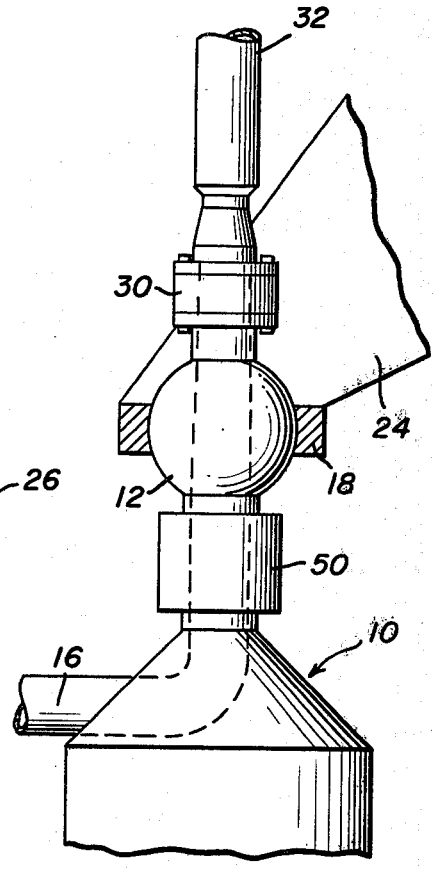
FIG. 5

OFFSHORE TOWER WITH BALL AND SOCKET JOINT HAVING FLUID FLOW PASSAGE

This invention relates to apparatus for effecting fluid flow past an articulated joint between two members. More particularly, this invention relates to a ball and socket swivel which permits fluid flow past the swivel between two angularly displaceable conduits, and especially such a swivel suitable for anchoring an offshort tower to a sea floor.

BACKGROUND OF THE INVENTION

Ball and socket articulated or swivel joints have been widely used for many years. These joints can employ a ball and socket with continuous uninterrupted mating or nesting surfaces when only a mechanical capability is sought. However, a conduit or hole is provided in both the ball and socket when it is necessary or desirable to pass a rod, cable or the like through the joint or when the joint is to be used as a fluid swivel through which a fluid is to flow. Ball and socket joints with fluid flow capability across the joint are generally limited as to angular displacement because of the necessity to have the hole in the ball at least in partial fluid flow direct engagement with a similar hole in the socket.

Two present fields greatly interested in ball and socket joints are offshore oil production, processing and transfer, and ship mooring. Offshore buoyant towers supported by the sea floor are used for oil exploration and production and mooring tankers. Such towers are sometimes advantageously secured to the sea floor through an articulated or swivel joint. Ball and socket joints have already been proposed for that purpose. See U.S. Pat. Nos. 4,155,670; 4,058,137; 4,048,944; 3,720,006; 3,708,985; 3,667,239; 3,572,408; and 2,988,144. The prior art, however, does not provide a ball and socket joint with a capability for fluid flow past the joint through a relatively large angular displacement.

SUMMARY OF THE INVENTION

According to the present invention there is provided an offshore tower comprising a buoyant column; a yoke at the lower end of the column; a socket joined to the end of the yoke; a base, adapted to be anchored to a sea floor, having a ball which fits in the socket for rotational joined movement relative to each other; a fluid delivery passageway, extending through the base and ball, communicating with a fluid swivel above the ball; and a fluid conduit means having a flexible portion, extending outwardly from the fluid swivel and into engagement with the column.

The flexible conduit means desirably also includes a second fluid swivel near the column to still better avoid putting stress on the flexible conduit when the column rotates and pivots.

For a column which is designed to be about vertical in still water, an elbow is extended from a fluid swivel at the ball top to another fluid swivel which is connected to the flexible conduit which in turn runs upwardly towards the column. It can join another fluid swivel near the column.

A quick connect-disconnect connector can be used to connect the ball to the sea floor base. In this way, the ball and socket can be preassembled on the tower and the tower moved into position for connection to the base previously secured to a sea floor site. Furthermore, the tower can be moved quickly at any time by opening the connector to free the column from attachment to the base.

BRIEF DESCRIPTION OF THE DRAWINGS

FIG. 1 is an elevational view of an always inclinded offshore tower having a ball and socket articulated joint, securing it to a base on the sea floor, with a fluid by-pass according to the invention;

FIG. 2 is an enlarged view of the ball and socket joint shown in FIG. 1;

FIG. 3 is similar to FIG. 1 but shows a ball and socket joint with fluid by-pass at the bottom of an offshore tower which stands vertical in still water;

FIG. 4 is an enlarged view of the lower part of the offshore tower shown in FIG. 3; and FIG. 5 is similar to FIG. 4 but illustrates a quick connect-disconnect connector which secures the ball to the base on the sea floor.

DETAILED DESCRIPTION OF THE DRAWINGS

To the extent it is practical and convenient, the same numbers will be used in the drawings to identify the same or similar elements or parts.

With reference to FIGS. 1 and 2, base 10 is secured to sea floor 11 by pilings or other suitable means. Ball 12, mounted to the top of base 10, contains a vertical hole 14 in fluid flow communication with conduit 16.

Socket 18 partially surrounds ball 12 in a rotatable and pivotal arrangement. Yoke 20 has two spaced apart legs 22 and 24 joined at their lower ends to socket 18 and at their upper ends to the lower end of buoyant column 26. Column 26 constitutes the main part of an offshore tower.

Column 26 is normally ballasted so that it is at an incline of about 30° from vertical in still water. FIG. 1 shows the column in phantom at that angle. However, with a tanker 28 moored to the tower as is also shown in FIG. 1, the column 26 will be inclined to an angle of $55° \pm 10°$ from the vertical under maximum tanker load. FIG. 1 shows the tower as so inclined.

A fluid swivel 30 is mounted on or above ball 18 in fluid communication with hole 14. Conduit 32, which can be wholly or partially a flexible hose, extends upwardly from fluid swivel 30 into engagement with column 26. Desirably, a fluid swivel 34 is positioned adjacent column 26 at the upper end of hose 32. A rigid conduit then extends into the column and continues to the column top where it is connected to appropriate control means for regulating fluid flow to or from a moored tanker.

The ball and socket joint permits the inclined column 26 to rotate unrestrictedly in a sea level circle, with or without a ship moored to it. In addition, the column can pivot at an angle in vertical plane. Also, the column can rotate to a limited extent approximately about the column axis. All movement of the column as described is readily accommodated by the described fluid by-pass system through the fluid swivel 30, flexible conduit 32 and the optional fluid swivel 34.

A second embodiment of the invention is illustrated by FIGS. 3 and 4. This embodiment is particularly useful in an offshore tower designed to be vertical, as shown in phantom in FIG. 3, in still water and inclined to an angle of $55° \pm 10°$ under maximum tanker mooring load. It is not feasible to extend a conduit, or even a flexible hose, from fluid swivel 30 directly upwardly into column 26 because too much bending stress would be placed on it when the tower is inclined. Therefore, elbow 40 is joined at one end to fluid swivel 30 and at the other end to fluid swivel 42. Conduit 44 then extends from fluid swivel 42 upwardly to optional fluid swivel 46 located close to column 26. A conduit in communication at its lower end with fluid swivel 46 extends through the column wall and runs upwardly in the column to near its top where it is joined to a fluid flow control system.

The ball and socket fluid by-pass structure is disclosed and described with respect to FIGS. 3 and 4 will readily accommodate movement of the tower as previously described without putting any more than acceptable stress on flexible conduit 44.

FIG. 5 is similar to FIG. 2 except that ball 12 is connected to base 10 by means of a quick connect-disconnect connector 50 through which fluid can flow. The use of connector 50 permits assembly of the ball and socket in operating arrangement before the tower is submerged and/or before the ball is connected to base 10. This makes it possible to position base 10 on the sea floor before the tower is lowered into position. The ball and socket joint can be assembled and attached to yoke 20 on shore followng which the tower can be floated to the base site. Lowering of the column end permits the units of the quick connection to be united to secure the column to the base. Whenever it becomes desirable to move the tower the connection 50 is quickly opened to free the column. One type of connection which can be used is commercially available from Vetco Company as model H4.

The foregoing detailed description has been given for clearness of understanding only, and no unnecessary limitations should be understood therefrom as modifications will be obvious to those skilled in the art.

What is claimed is:

1. An offshore tower comprising:

a buoyant column;

a yoke at the lower end of the column;

a socket joined to the end of the yoke;

a base, adapted to be anchored to a sea floor, having a ball which fits in the socket for rotational joined movement relative to each other so that the column can rotate unrestrictedly in a sea level circle, including axial rotation of the column relative to the base;

a fluid delivery passageway, extending through the base and ball, communicating with a fluid swivel above the ball; and a fluid conduit means having a flexible portion, extending outwardly from the fluid swivel and into engagement with the column.

2. An offshore tower according to claim 1 in which the fluid conduit means includes a second fluid swivel near the column.

3. An offshore tower according to claim 1 in which the fluid conduit means includes an elbow extending from the swivel to a second fluid swivel from which the fluid conduit extends into engagement with the column.

4. An offshore tower according to claim 3 in which the fluid conduit means includes a third fluid swivel near the column.

5. An offshore tower according to claim 1 in which a quick connect-disconnect connector joins the ball to the base and the connector permits fluid flow therethrough in communication with the passageway.

* * * * *